United States Patent [19]

Nelson et al.

[11] Patent Number: 4,474,011

[45] Date of Patent: Oct. 2, 1984

[54] ONCE-THROUGH STEAM GENERATOR

[75] Inventors: Arthur W. Nelson, Sugarland; James H. Ragland, Houston, both of Tex.

[73] Assignee: Shell California Production Inc., Houston, Tex.

[21] Appl. No.: 494,145

[22] Filed: May 12, 1983

[51] Int. Cl.[3] ..... F01K 9/00

[52] U.S. Cl. ..... 60/648; 166/272; 166/303; 165/145; 165/147; 165/158; 122/32; 60/690

[58] Field of Search ..... 60/654, 691, 685, 690, 60/648, 692; 166/272, 303; 165/158, 146, 147, 145; 122/32

[56] References Cited

U.S. PATENT DOCUMENTS

| | | | |
|---|---|---|---|
| 401,685 | 4/1889 | Canfield | 165/147 |
| 2,271,648 | 2/1942 | Kleist | 165/147 |
| 2,475,604 | 7/1949 | Frisch | 165/158 |
| 2,689,839 | 9/1954 | Heckert | 165/147 |
| 3,150,716 | 10/1959 | Strelzoff | 166/354 |
| 3,336,747 | 9/1965 | Applebaum | 60/678 |
| 3,527,290 | 8/1968 | Lossing | 165/158 |
| 3,827,243 | 8/1974 | Paull | 166/272 |

FOREIGN PATENT DOCUMENTS

| | | | |
|---|---|---|---|
| 245010 | 2/1966 | Austria | 165/147 |
| 7916 | of 1838 | United Kingdom | 165/146 |
| 182773 | 9/1923 | United Kingdom | 165/158 |

*Primary Examiner*—Allen M. Ostrager

[57] ABSTRACT

An evaporator for producing wet steam in a cogeneration plant wherein the evaporator is a multiple pass unit having continuous in-tube flow paths from inlet to outlet. The evaporator is a shell and tube type with the clean steam on the shell side and water in the tubes. The evaporator is particularly useful in a cogeneration plant used in a secondary recovery process using contaminated wet steam.

8 Claims, 3 Drawing Figures

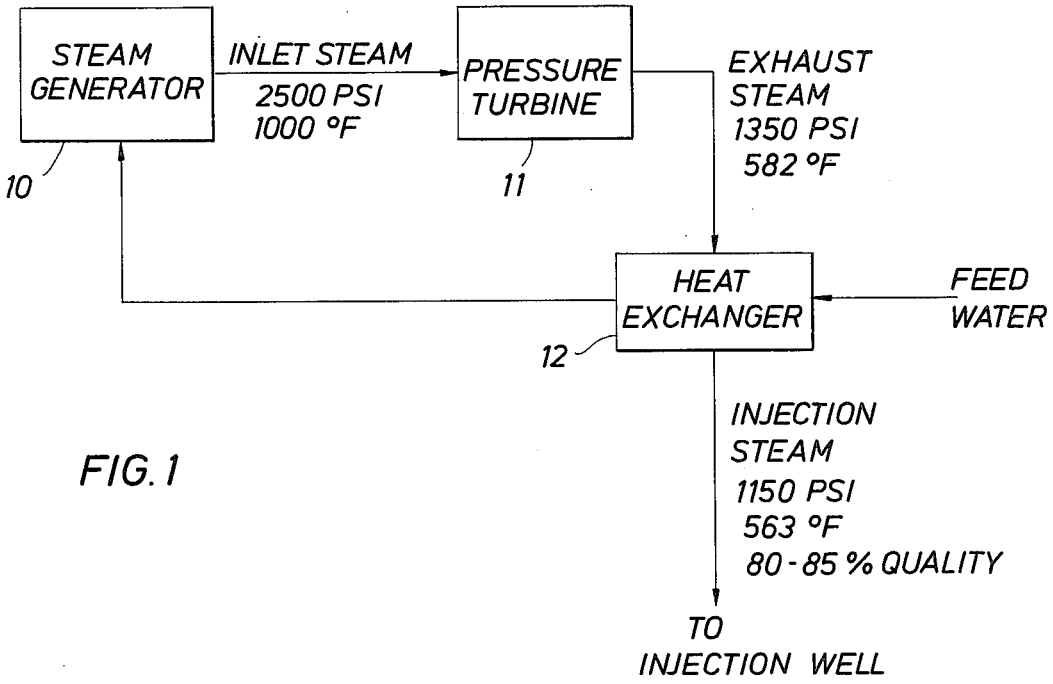
FIG. 1
FIG. 2
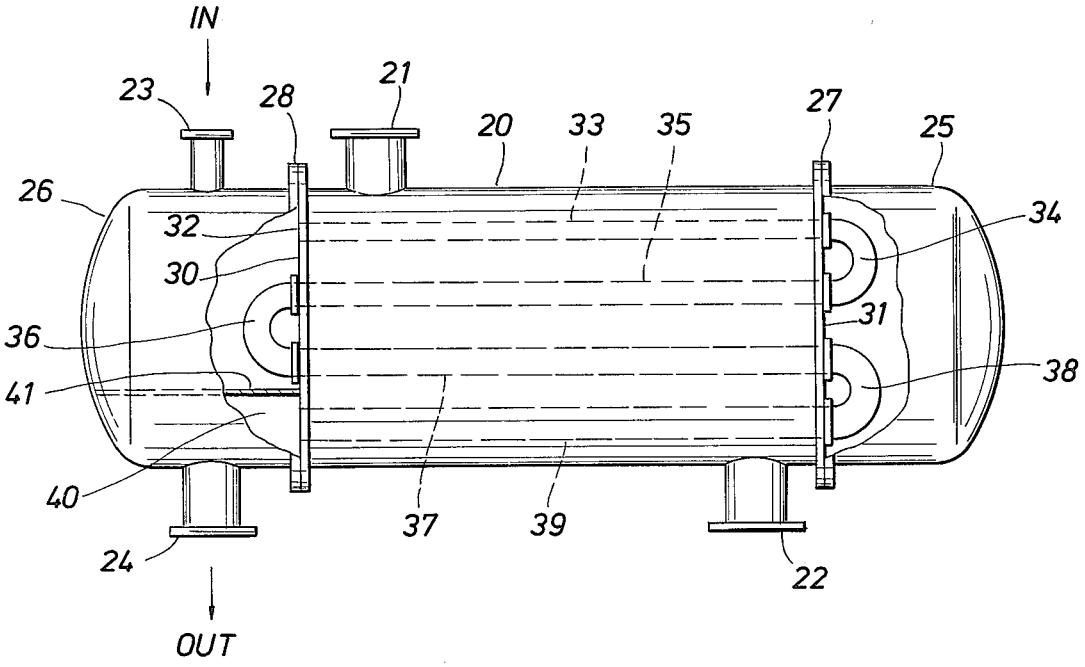

ONCE-THROUGH STEAM GENERATOR

BACKGROUND OF THE INVENTION

The present invention pertains to generating low quality steam containing dissolved solids for use in a thermal recovery process of crude oil and particularly to a cogeneration system for producing the low quality steam. One of the most successful methods for recovering heavy crude oil has been the use of steam to heat the formation to reduce the viscosity of the oil and permit it to be pumped from the reservoir. Various processes for steam thermal recovery have been developed such as steam floor where steam is injected into one well to drive the crude oil to a second or production well. Another is a steam soaking method in which the steam is injected into one well for a time with the well then being shut in to permit the steam to heat the formation after which the well is produced to remove the crude oil. All of these methods require a large amount of steam that requires a corresponding large quantity of water. Of course, some of the water used to form the steam is recovered with the produced crude oil but a large quantity of water remains in the formation. Since a large number of heavy oil formations are located in areas where water supplies are limited, the practice has developed of using brakish water containing a large quantity of dissolved salts for forming the steam. To prevent the salts from being dissolved out of the water during the steam formation phase, it has been customary to use low quality steam, for example, 80–85% steam. The salts remain dissolved in the remaining 15% or water phase of the steam. In order for this system to operate satisfactorily, it has been necessary to design the heaters for producing the steam using a single continuous flow path for the water. This ensures that the quality of the steam is maintained at the desired level and at no point in the heater does the steam become substantially dry steam, which would cause depositing of the salts as scale on the heating surfaces.

The above described system is utilized extensively and all of the heaters are either fired with natural gas or heating oil. In recent years the price of natural gas and/or heating oil has increased to a level that seriously affects the economics of the thermal recovery process. In addition, various regulatory measures have been passed in an attempt to conserve natural gas for other uses than firing heaters. Thus, it has become desirable to look at alternate fuels for producing the steam for thermal recovery processes.

An alternate fuel that could be used to fire the heaters is, of course, coal. While coal could be used, the present practice of a large number of relatively small heaters does not lend itself to coal firing. Further, efficiencies that could be achieved with coal firing of the present heaters would be low compared to what can be achieved in large central power plants.

SUMMARY OF THE INVENTION

The present invention solves the problems of thermal recovery processes by using a coal generation system wherein relatively high pressure super-heated steam is generated in large central power plant boilers and the exhaust steam from high pressure turbines is used as a heating medium for the heaters supplying the low quality steam to the thermal recovery process. Use of a large central generating plant permits high efficiency coal firing of the boiler. The design of coal fired high pressure steam plants is well developed and the technology and equipment required is available. The exhaust steam from the turbines can be used on site or can be transported over reasonable distances to heat exchangers that are positioned in the same locations as the presently used gas fired heaters.

The heat exchangers used in the cogeneration system are of a special design shell and tube heat exchangers wherein each flow path through the exchanger is formed by a continuous tube. While the flow path is a continuous tube, it may have numerous passes through the shell of the heat exchanger so that an efficient design can be obtained. Since the water is introduced into the heat exchanger in a liquid form and exits as 80–85% quality steam it is necessary to increase the size of the tubes in the continuous flow path as it makes its various passes through the heat exchanger. Also, the heat exchanger must be capable of being assembled and provisions made to clean the interior of the tubes to remove scale deposits. The present invention solves these problems by providing individual tubes for each tube pass and coupling the individual tubes to one another in the head portions of the heat exchanger by means of removable U-bends. The use of U-bends also permits the increasing of the tube diameter from one pass to the succeeding pass to provide for the increased volume of fluid between passes. While various means may be provided for removing the U-bends, they are preferably flange mounted to the individual tubes so that they can be readily removed.

While in the above description the preferred fuel is coal, other fuels such as fuel oil or natural gas can be used, if available. Also, under some conditions it may be necessary to fire the central power plant boilers with fuel oil or natural gas. The heat exchange will operate with any type of central power plant for supply low quality steam for a thermal recovery project.

BREIF DESCRIPTION OF THE DRAWINGS

The present invention will be more easily understood from the following detailed description when taken in conjunction with the attached drawings in which:

FIG. 1 is a block diagram of the complete system.

FIG. 2 is an elevation view of the heat exchanger with a portion shown in section.

DESCRIPTION OF THE PREFERRED EMBODIMENT

Figure 3:
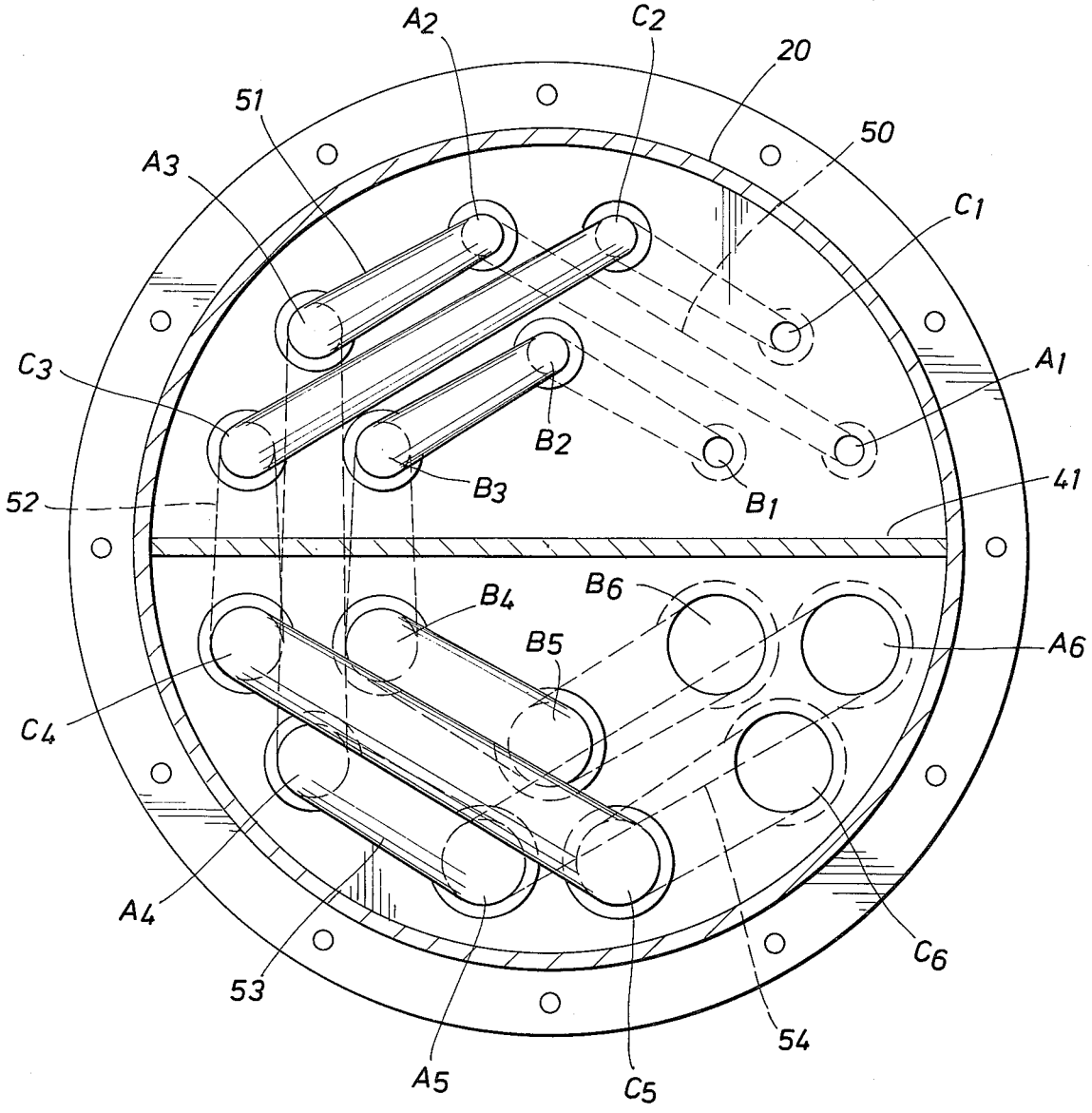
FIG. 3 is an end view of the heat exchanger shown in FIG. 1 drawn to an enlarged scale.

Referring to FIG. 1 there is shown a steam generator 10 which is preferably a coal fired central power steam generating boiler producing high pressure superheated steam, for example, steam at 2400 psi and 1000° F. The steam from the boiler is fed to a back pressure turbine 11 which is coupled to a generator (not shown) for producing base load electricity. The back pressure turbine should be designed to exhause the steam at a pressure and temperature which will depend upon the desired pressure of the thermal recovery steam (process use pressure). The exhaust steam from the back pressure turbine is sent to a heat exchanger 12 which is preferably of the shell and tube type. The turbine may have multiple extraction points for supplying steam to the heat exchanges. This is particularly desirable when a plurality of heat exchangers connected in a series feed forward configurations are used. Further, the turbine may include separate sections, for example, high, intermediate and low pressure sections. The steam flows in the shell section of the heat exchanger and is condensed with the condensate being returned to the steam generator 10. The heat exchanger is supplied with feed water as shown and produces steam for the thermal recovery process at 1150 psi, 560° F. and 80–85% steam quality. As explained above, in most areas where thermal recovery processes are utilized there is insufficient fresh water for use in the thermal recovery process and it has become a common practice to use brakish waters and low quality wet steam so that the dissolved minerals and salts will be retained in the liquid phase of the steam. This prevents the salts or minerals from being evaporated and forming a scale on the heat exchanger tubes. While the dissolved salts are retained in the liquid phase, it is preferable that the water be treated so that it is relatively soft. This will prevent the calcium from depositing as scale on the heat exchanger tubes.

Referring now to FIG. 2, there is shown the heat exchanger for use in the present process, partially in elevation and partially in section. In particular, the shell 20 of the heat exchanger is provided with an inlet 21 for the turbine exhaust steam and an outlet 22 for the condensate. The heat exchanger is provided with two heat sections 25 and 26 which are coupled to the shell section by means of flange joints 27 and 28. The head section 26 is also provided with an inlet 23 for the feed water and an outlet 24 for the low quality steam. In addition, the heat exchanger is provided with a baffle 41 which separates the inlet portion of the heater from the outlet portion. The shell 20 of the heater is provided with tube sheets 30 and 31 at each end. The tube sheet 30 has an opening 32 which forms the inlet to the first tube pass 33 through the heater. At the opposite end of the heater, the tube 33 is connected by a U-shaped tube 34 to the second pass tube 35. Similarly, tube 35 is connected by a U-shaped tube 36 to the third pass 37 of the heater which in turn is connected by U-shaped tube 38 to the final pass 39. The final tube pass 39 opens into the space 40 where the steam can then flow out the outlet 24.

As explained above, the tube passes 33, 35, 37 and 39 may be progressively larger in cross sectional area to accommodate the larger volume fluid flow through the heat exchanger. U-bend portions 34, 36 and 38 are shown as having flange connections so that they may be readily removed from the ends of the tubes. This will permit the removal of the U-bends so that the individual tubes 33, 35, 37 and 39 may be cleaned to remove scale deposits therefrom. While flange connections are preferred, obviously other removable connections such as unions or similar threaded connections may also be used. From the above description it is seen that a single continuous tube pass is provided from the inlet of the tube 32 to its outlet 40. This ensures that the solids dissolved in the inlet water will remain in the liquid phase and be carried out with the steam through the outlet 24. It can readily be appreciated that if a tube pass terminated in a header which then fed a plurality of tubes in the second pass, the possibility exists that some tubes in each pass would have substantially dry steam which would cause the solids to deposit a scale on the walls of the tubes. While only four passes are shown in FIG. 2, obviously the heat exchanger may be provided with any number of passes in each individual flow path. For example, as described below with respect to FIG. 3, six passes may be easily provided.

Referring now to FIG. 3, there is shown an end view of the heat exchanger having six individual passes. Each pass is indicated by the letters A, B and C with subscripts 1, 2, 3, 4, 5 and 6 indicating the particular pass. Also, as shown, the cross section of each individual tube pass increases as the fluid flows through the heat exchanger. The dotted lines indicate the U-bends which forms the connection between the tube $A_1$ and the tube $A_2$ while the line 51 indicates a U-bend connecting tube $A_2$ to $A_3$. The remaining U-bends are indicated by the numerals 52, 53 and 54. It can be readily appreciated that while only three continuous tube passes are shown in FIG. 3, additional tube passes can be provided in the heat exchanger. The number of individual flow paths through the heat exchanger will of course, depend upon the overall diameter of the shell 20 and the size of the individual tubes. It is desirable to have as many tube passes as possible to increase tbe heat transfer area of the heat exchanger and increase it efficiency.

From the above description, it is seen that the invention provides an efficient method by which coal may be used to supply low quality steam for use in a thermal recovery process. The invention burns the coal in an efficient manner in a large central steam-producing generator to produce high pressure and high temperature steam. The high pressure/high temperature steam is retained in a closed cycle and thus it is not contaminated by the water used for forming the low quality steam used in the thermal recovery. This ensures that the high pressure coal fired steam generator can be operated in a conventional manner as presently utilized in central generating plants. The use of the back pressure turbine provides a method by which part of the energy of the high pressure steam may be recovered while providing steam which can be used for producing the low quality thermal recovery steam.

In some applications it may be desirable to use a number of heat exchangers connected in series to supply the thermal recovery steam. This would allow the use of multiple extraction points on turbines and improve the overall efficiency.

What is claimed is:

1. A method for producing low quality steam containing dissolved solids for use in the thermal recovery of crude oil, said method comprising:

generating high pressure, high quality steam;

partially expanding and reducing the pressure and temperature of the high quality steam in a steam turbine;

exhausting the steam from the steam turbine into the shell side of a shell and tube heat exchanger; and introducing the water containing the dissolved solids into the tubes of the heat exchanger through an inlet while maintaining a continuous in-tube flow path, the cross-section of said flow path increasing in size from the inlet to the outlet, and the flow rate of the water/steam mixture through the tubes being sufficiently high to maintain the solids dissolved in the liquid phase and the tubes substantially clean and removing the low quality steam containing dissolved solids through the outlet of the heat exchanger.

2. The method of claim 1 wherein the water containing dissolved solids is caused to flow through multiple parallel flow paths, wherein each flow path is a single continuous in-tube flow path.

3. An apparatus for producing low quality steam containing dissolved solids for use in the thermal recovery of crude oil, said apparatus comprising:

a steam generator for producing high quality, high pressure superheated steam;

a steam turbine, said steam generator being coupled to said turbine; and a shell and tube heat exchanger, at least a portion of the steam supplied to said turbine being supplied to the shell side of said heat exchanger and said solid-containing water being introduced in the tube side of said heat exchanger, said heat exchanger having a continuous in-tube flow path from inlet to outlet for each tube of the heat exchanger, the cross-sectional area of said flow path increasing between the inlet and outlet.

4. The apparatus of claim 3 wherein said heat exchanger has a plurality of tubes forming individual flow paths.

5. The apparatus of claim 4 wherein each flow path has multiple passes through the tube section of the heat exchanger.

6. The apparatus of claim 5 wherein tubes forming a flow path are joined together at each end of the exchanger by removable U-bend tubes.

7. The apparatus of claim 3 wherein a plurality of heat exchangers connected in series are used and said turbine has mutiple extraction points for supplying steam to said plurality of heat exchangers.

8. The apparatus of claim 7 wherein said turbine has at least a high pressure and low pressure section disposed in separate housings.

* * * * *